United States Patent [19]

Porter

[11] Patent Number: 4,575,974

[45] Date of Patent: Mar. 18, 1986

[54] BUILDING STRUCTURE

[76] Inventor: William H. Porter, P.O. Box 249, Saugatuck, Mich. 49453

[21] Appl. No.: 591,266

[22] Filed: Mar. 19, 1984

[51] Int. Cl.[4] ..... E04B 1/32

[52] U.S. Cl. ..... 52/86; 52/639

[58] Field of Search ..... 52/83, 86, 639, 643, 52/263, 82, 90, 93, 641, 655

[56] References Cited

U.S. PATENT DOCUMENTS

| | | | |
|---|---|---|---|
| 2,270,161 | 1/1942 | Briggs | 52/263 |
| 3,562,975 | 2/1971 | Moss | 52/82 |
| 4,347,690 | 9/1982 | Wallace | 52/86 |

FOREIGN PATENT DOCUMENTS

| | | | |
|---|---|---|---|
| 418613 | 2/1967 | Switzerland | 52/93 |
| 126492 | 5/1919 | United Kingdom | 52/93 |
| 142128 | 4/1921 | United Kingdom | 52/641 |

*Primary Examiner*—James L. Ridgill, Jr.

*Attorney, Agent, or Firm*—Emrich & Dithmar

[57] ABSTRACT

A low cost building structure includes a support frame having a lateral cross section in the shape of a trapezium. The structure's enlarged base increases its stability while the inwardly inclined forward and aft supports increase its strength while reducing wind loading forces. Designed for field assembly and including a metal support frame as well as metal roof and wall panels in a preferred embodiment, the building structure is particularly adapted for use as a carport or as a garage wherein a conventional door may be mounted adjacent an open front portion thereof. The side walls covering the trapezium-shaped support frame members may be extended forward to provide a vertical, or near vertical, front wall while retaining the advantages of the trapezium shape. The roof is comprised of a one-piece section which is bent at the ridge eliminating the need for a ridge cap.

14 Claims, 8 Drawing Figures

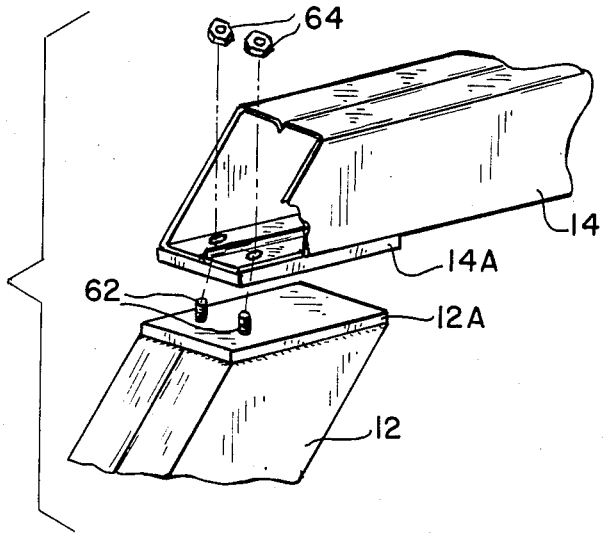
FIG. 8
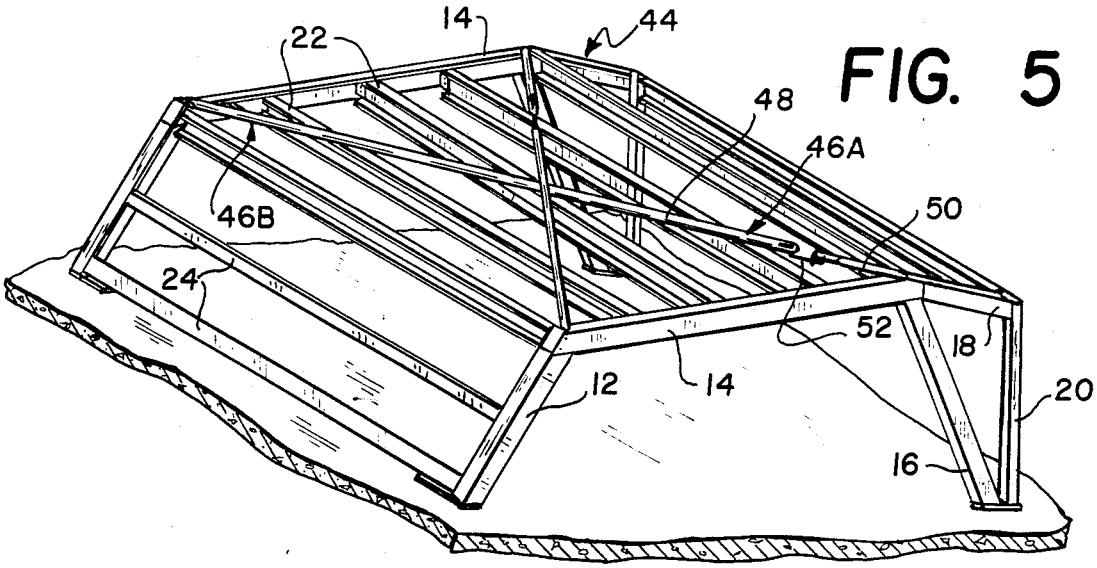
FIG. 5
FIG. 6
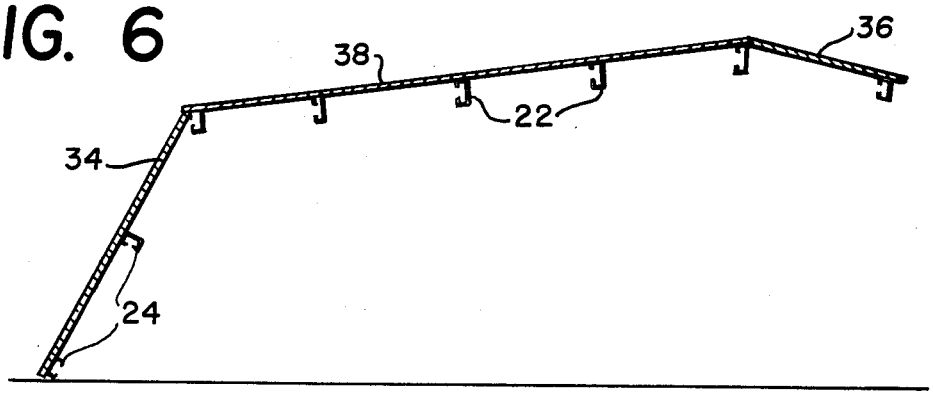

BUILDING STRUCTURE

BACKGROUND OF THE INVENTION

This invention relates generally to building structures and is particularly directed to a lightweight, low cost, easily assembled building structure which is sturdy and stable.

Storage/utility buildings and sheds are generally comprised of metal panels mounted on a skeletal metal frame, are typically provided in kit form and may be assembled by even an inexperienced buyer. Such structures are generally portable in nature, although sometimes are permanently mounted upon a foundation or concrete slab. Prefabricated metal units of this type generally do not have a significant load carrying capacity and thus possess relatively short usable lifetimes in hostile environments, ultimately yielding to either excessive wind loading or the weight of accumulated snowfall.

These prior art structures are generally characterized by a symmetrical support frame comprised of a plurality of vertical columns which provide support for various horizontal cross members, or roof purlins. The vertical support columns are oriented to accommodate gravitational loads but do little with respect to wind loading and, in fact, result in maximum building cross sections and greater wind loading. Increasing the strength of this type of structure generally requires additional structural components and improved building design. Both increase the cost of the building structure. Examples of such buildings can be found in U.S. Pat. Nos. 3,308,596 to Cooper et al., 3,462,895 to Wormser, 3,974,602 to Pohl et al., 4,011,697 to Fedolfi, 4,078,341 to Peterson et al., and 4,187,651 to Tolsma.

These structures are characterized as including vertical support columns and horizontal cross members. As such, these building structures are capable of withstanding only limited side loading and thus are not particularly stable. The present invention is intended to overcome the aforementioned limitations of the prior art by providing a novel building structure possessing characteristics not previously available.

OBJECTS AND SUMMARY OF THE INVENTION

Accordingly, it is an object of the present invention to provide a lightweight, low cost, and easily assembled building structure.

It is another object of the present invention to provide a building structure which is particularly adapted for use as a carport or a garage but which may also be used for a wide variety of purposes.

Yet another object of the present invention is to provide a portable building structure having a support frame of high strength and stability using a minimum number of support frame members.

A further object of the present invention is to provide a building structure particularly adapted for withstanding high wind loads and large vertical loading.

A still further object of the present invention is to provide a rigid building structure which can be easily assembled in the field by a minimum number of workers using only a few tools.

These and other objects are accomplished by the present invention which contemplates a building structure having a lateral cross section in the shape of a trapezium. Comprised of a metal roof, walls and support members, the building structure is capable of withstanding large weight and wind loading factors. The roof panel is a one-piece section which is bent at the ridge eliminating the need for a ridge cap while the beam and truss members are tubular and the purlins are roll-formed into a "C" or a channel section. The structure itself is low cost, easily assembled in the field by only a few workers using minimal tools, and is particularly adapted for use as a carport or a garage including a conventional door mounted thereto. The support columns may be either mounted to or supported by a foundation or may be linked by means of a tension tie or cable for increased structural strength and stability.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 5 is a perspective view of another embodiment of the support structure of a trapezium-shaped building structure in accordance with the present invention;

FIG. 6 is a cross-sectional view of the building structure of FIG. 5 taken along the center line thereof;

FIG. 8 is a perspective view showing an arrangement for coupling a truss to a support column, or beam, for use in the trapezium-shaped building structure of the present invention.

DESCRIPTION OF THE PREFERRED EMBODIMENT

Figure 1:
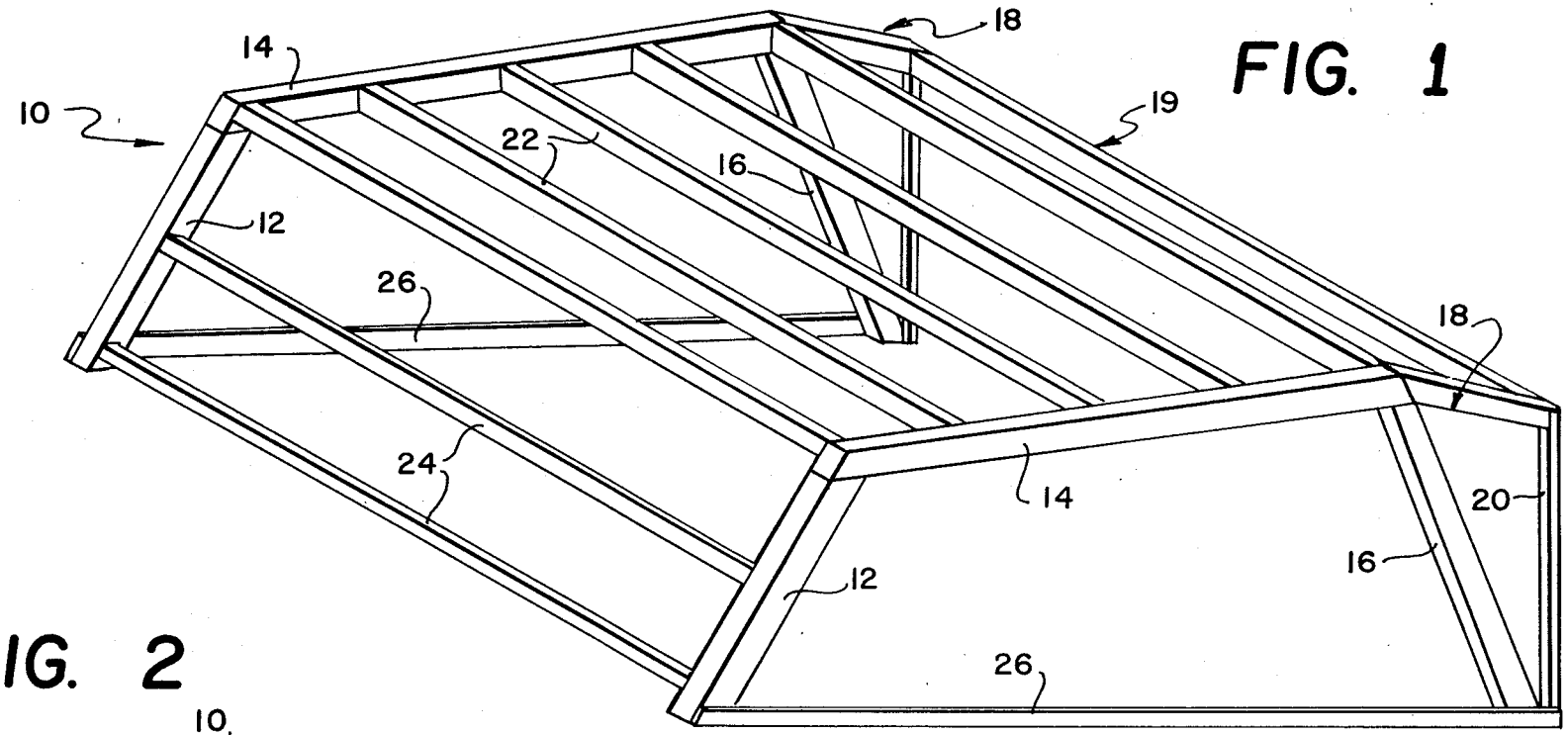
FIG. 1 is an upper perspective view of the support frame for a building structure having a lateral cross section in the form of a trapezium in accordance with the present invention.
Figure 2:
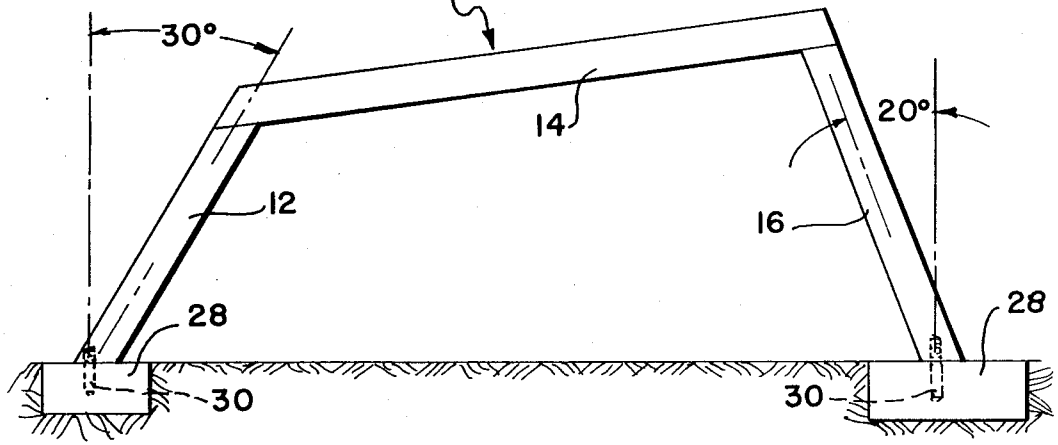
FIG. 2 is a side elevation view of the support frame of FIG. 1.

Referring to FIGS. 1 and 2, there are respectively shown upper perspective and side elevation views of a support frame 10 for use in the building structure of the present invention.

Support frame 10 includes a pair of rear columns, or beams, 12 coupled to a pair of front columns, or beams, 16 by means of respective trusses 14. Each of the rear and front columns 12, 16 is positioned in a respective corner of the building structure support frame 10, with each truss 14 forming an upper, lateral edge of the support frame 10. The rear columns 12 are coupled together by means of a pair of purlins, or wind girts, 24 which extend horizontally along the entire width of the support frame 10. Similarly, the trusses 14 are coupled by means of a plurality of generally horizontally extending purlins 22. In a preferred embodiment, the rear and front columns 12, 16 are inclined inwardly toward one another and form respective angles of 30° and 20° with respect to the vertical as shown in FIG. 2.

In one embodiment, as shown in FIG. 1, a pair of struts 18 are mounted to forward portions of the union of respective trusses 14 and front columns 16 and extend forward therefrom. The distal end of each strut 18 is securely coupled to and supported by a respective auxiliary column 20. The lower end portion of each auxiliary column 20 is positioned immediately adjacent and is coupled to the lower edge of a respective front column 16. By mounting the forward frame 19 comprised of struts 18 and auxiliary columns 20 to a forward portion of the support frame 10, the advantages of the unique trapezium shape of the support frame 10 are realized, while the support frame is provided with a generally vertical forward-facing lateral portion which may be desirable in various applications such as when the building structure of the present invention is used as a carport or as a garage. In this case, the generally vertical forward lateral portion of the support frame may either be left open or may be provided with a conventional swinging or rolling door.

In one embodiment, the lower end portions of the rear and front columns 12, 16 are securely coupled together by means of a tension tie, or truss, 26 as shown in FIG. 1. With the upper end portion of each rear and front column on a respective side of the support frame 10 securely coupled by means of a truss 14 and their respective lower ends securely connected by means of tension tie 26, the trapezium shape of the lateral portion of the support frame 10 is maintained. In another embodiment as shown in FIG. 2, the lower portions of the rear and front columns 12, 16 are maintained stationary with respect to one another by securely mounting the lower ends thereof to a respective column support, or foundation, 28. Each rear and front column 12, 16 may be securely affixed to a respective column support 28 in a conventional manner such as by means of a mounting bolt 30. From the side views of FIGS. 1 and 2, it can be seen that the trusses 14 are not horizontal, but are oriented upwardly from rear to front.

Figure 3:
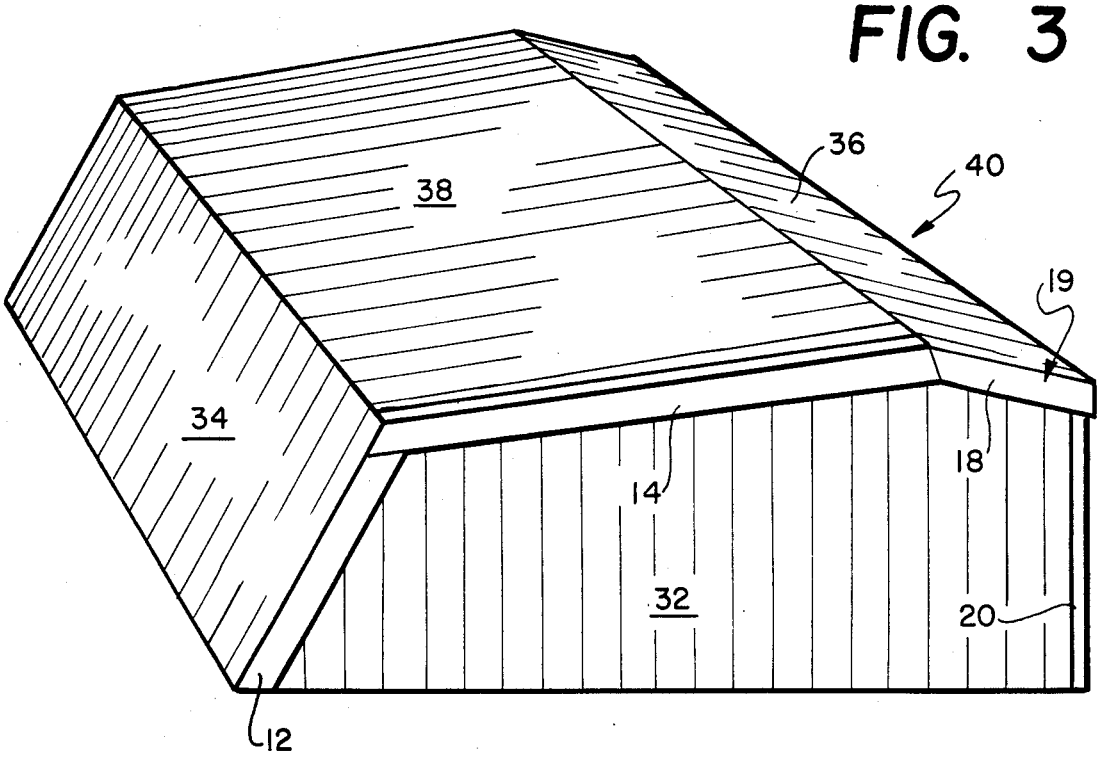
FIG. 3 is an upper perspective view of a building structure in accordance with the present invention including back and side wall panels as well as roof panels.
Figure 4:
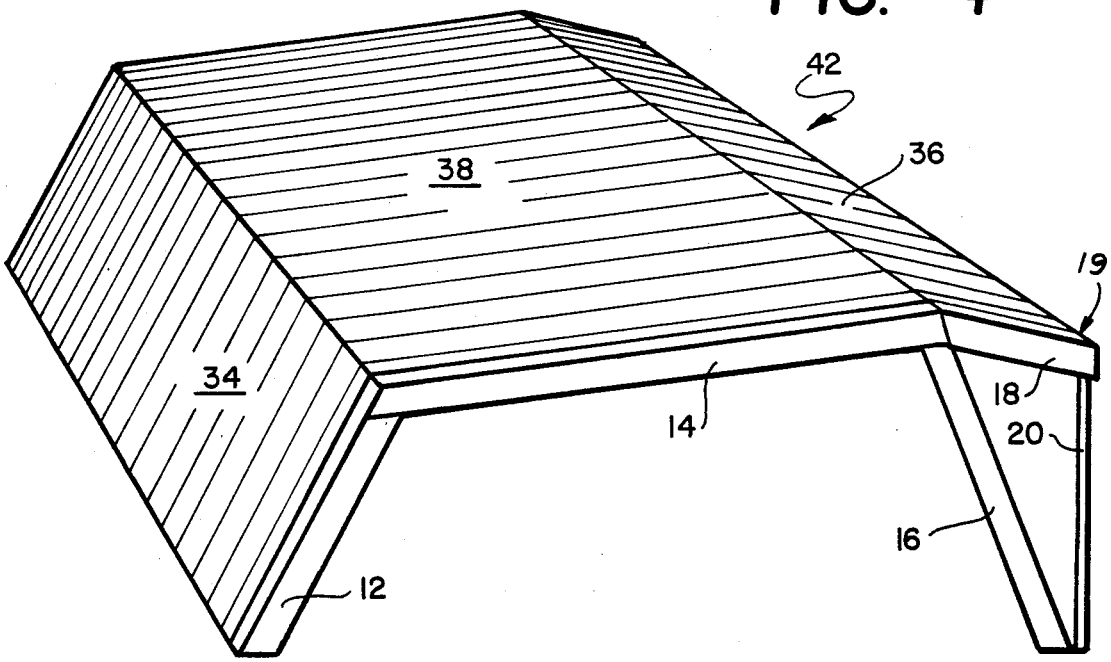
FIG. 4 is an upper perspective view of the building structure of FIG. 3 where the side panels have been omitted.

Referring to FIGS. 3 and 4, there are respectively shown two embodiments of the present invention wherein a roof and various side panels have been positioned upon the support frame 10 of the present invention. In FIG. 3, a rear wall 34 is shown mounted to the rear columns 12 of the building structure 40. Purlins 24 provide reinforcement of the rear wall 34 as shown in FIG. 1. An aft roof section 38 is shown mounted to trusses 14 and supported by purlins 22. Similarly, a forward roof section 36 is secured to an upper portion of the forward frame 19 which is comprised of struts 18 and auxiliary columns 20.

In the arrangement of FIG. 4, the sidewalls have been omitted from the support frame. Thus, only rear wall 34, aft roof section 38, and the forward roof section 36 are coupled to and supported by the support frame of the present invention. In this arrangement, building structure 42 could be used as a carport. The forward roof section 36 supported by forward frame 19 provides additional cover for a vehicle positioned beneath building structure 42 and compensates for the inwardly inclined orientation of forward columns 16. The forward and aft roof sections 36, 38 are, in combination, comprised of a one-piece section which is bent at the ridge eliminating the need for a ridge cap. In addition, the forward and aft roof sections 36, 38 as well as the rear wall 34 are comprised of a roll-formed corrugated metal in a preferred embodiment for strength and economy.

Referring to FIG. 5, there is shown a perspective view of another embodiment of a trapezium-shaped building structure 44 in accordance with the present invention. Each of the purlins 22, 24 are roll formed into a "C"-shape or channel section for maximum strength and economy. This is shown in FIG. 5 and more clearly depicted in FIG. 6 which is a lateral cross sectional view of the structure of FIG. 5. From FIG. 6, it can be seen that the forward and aft roof sections 36, 38 are formed of a single piece section which is bent at the ridge eliminating the need for a ridge cap. In the structure of FIG. 5, a pair of diagonal straps 46A, 46B are each securely coupled to an aft end of one truss and to a forward end of the other facing truss. Each of the diagonal straps 46A, 46B increases the strength of the support structure of the building and includes an aft strap 48, a forward strap 50, and an offset stud 52 coupling the forward and aft straps. The manner in which respective forward and aft straps are coupled is shown in FIG. 7.

Figure 7:
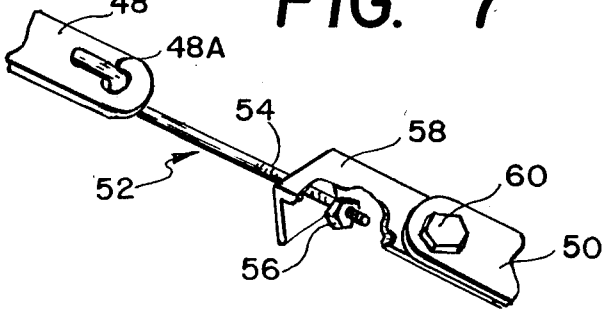
FIG. 7 is a perspective view showing the coupling between diagonal straps positioned on an upper portion of the building structure and coupling laterally spaced, facing trusses.

Referring to FIG. 7, one end of the offset stud 52 is inserted within an aperture 48A in the aft strap 48, while the other end of the offset stud is inserted in an aperture in an angle 58. Angle 58 is, in turn, securely coupled to the forward strap 50 by means of a nut and bolt combination 60. The offset stud 52 includes a threaded portion 54 which is inserted through the aperture of angle 58 and is secured thereto by means of a nut 56 positioned thereon. By rotating nut 56, increasing tension can be applied by means of a respective diagonal strap to the forward and aft end portions of each facing, laterally positioned truss 14. The diagonal straps 46A, 46B provide a lightweight, easily installed, hidden means for substantially strengthening the support structure of the trapezium building structure of the present invention.

Referring to FIG. 8, there is shown an arrangement for connecting a support column 12 with a truss 14. The support columns and truss members in the present invention are tubular in cross section for increased strength and reduced weight. The upper portion of each column, or beam, 12 is provided with a mounting plate 12A. Similarly, each end of a truss 14 is provided with a mounting plate 14A. Each of the mounting plates 12A, 14A is provided with a pair of apertures through which a respective bolt 62 is inserted when the truss mounting plate 14A is positioned upon the column mounting plate 12A with the respective apertures therein in alignment. A nut 64 is positioned upon each of the bolts 62 in firmly coupling a respective support column 12 to a truss 14. The aperture in the end of truss 14 is covered by either a roof section or by an upper portion of the rear wall 34 so as to hide the column-truss mounting components from sight and protect them from the elements.

There has thus been shown a low-cost building structure having a support frame with inwardly inclined forward and aft support columns for increased building strength and stability. The trapezium-shaped lateral cross section of the support frame reduces forward and aft wind loading for increased lateral stability. The support frame is provided with a roof, a rear wall, and two sidewalls for use as either a carport or a garage.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A building structure comprising:

a pair of parallel, linear, inclined forward support columns, each fixedly positioned at a lower end thereof;

a pair of parallel, linear, aft support columns, each fixedly positioned at a lower end thereof and inclined toward a respective forward support column;

a pair of linear, nonhorizontal trusses, each securely coupled at a respective end thereof to the upper end portions of a forward support column and an aft support column;

a plurality of first purlins coupled at respective ends thereof to a respective one of said trusses along the length thereof;

at least one second purlin securely coupled at respective ends thereof to one of said aft support columns;

a generally vertical frame mounted to the forward portion of the building structure and extending substantially the width thereof;

a rear wall positioned upon and supported by said aft support columns and said at least one second purlin; and a roof panel positioned upon and supported by said plurality of first purlins and trusses and said vertical frame, said roof panel including a single roof section having an angled ridge portion defined by the joinder of the building structure and said generally vertical frame mounted to a forward portion thereof.

2. A building structure in accordance with claim 1 wherein said roof and rear wall are comprised of roll-formed corrugated metal.

3. A building structure in accordance with claim 1 wherein said plurality of first purlins and said at least one second purlin are oriented generally horizontally.

4. A building structure in accordance with claim 1 wherein the lower end portions of said forward and aft support columns are securely mounted to and supported by a foundation.

5. A building structure in accordance with claim 1 further including a pair of lateral panels each coupled to and supported by a respective side of said vertical frame.

6. A building structure in accordance with claim 1 wherein said purlins include a C-shaped transverse cross section.

7. A building structure in accordance with claim 1 further including a pair of side panels, each mounted to a respective truss and to said forward and aft support columns coupled thereto.

8. A building structure in accordance with claim 7 wherein said side panels are comprised of sheet metal.

9. A building structure in accordance with claim 1 further including truss means for connecting the lower end portions of each pair of said forward and aft support columns coupled to the same truss.

10. A building structure in accordance with claim 9 wherein said truss means comprises a tension tie.

11. A building structure in accordance with claim 1 wherein said support columns, said purlins, and said trusses are comprised of metal.

12. A building structure in accordance with claim 11 wherein said support columns, said purlins, and said trusses are tubular in structure.

13. A building structure in accordance with claim 1 further comprising a pair of diagonal support members each coupled at a first end thereof to an aft portion of one of said trusses and at a second end thereof to a forward portion of the other truss.

14. A building structure in accordance with claim 13 wherein each of said diagonal support members includes a strap element.

* * * * *